US008573748B2

(12) United States Patent
Kawamura et al.

(10) Patent No.: US 8,573,748 B2
(45) Date of Patent: Nov. 5, 2013

(54) RECORDING HEAD

(75) Inventors: Shogo Kawamura, Numazu (JP); Toshiaki Hirosawa, Hiratsuka (JP); Hiroshi Abe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 293 days.

(21) Appl. No.: 13/030,505

(22) Filed: Feb. 18, 2011

(65) Prior Publication Data

US 2011/0211024 A1 Sep. 1, 2011

(30) Foreign Application Priority Data

Mar. 1, 2010 (JP) ..... 2010-044138

(51) Int. Cl.
*B41J 2/05* (2006.01)

(52) U.S. Cl.
USPC ..... 347/58

(58) Field of Classification Search
None
See application file for complete search history.

(56) References Cited

U.S. PATENT DOCUMENTS

| | | | | |
|---|---|---|---|---|
| 6,471,901 | B1 | 10/2002 | Kawamura et al. | |
| 6,536,868 | B1 | 3/2003 | Kawamura et al. | |
| 7,533,960 | B2 | 5/2009 | Yasuda et al. | |
| 7,547,094 | B2 | 6/2009 | Kawamura et al. | |
| 7,775,638 | B2 | 8/2010 | Hirosawa et al. | |
| 2004/0155931 | A1 * | 8/2004 | Mori | 347/58 |
| 2009/0009559 | A1 * | 1/2009 | Jindai et al. | 347/50 |
| 2009/0179965 | A1 | 7/2009 | Hirosawa et al. | |
| 2009/0267994 | A1 | 10/2009 | Suganuma et al. | |

FOREIGN PATENT DOCUMENTS

| | | | |
|---|---|---|---|
| JP | 7-335680 | A | 12/1995 |
| JP | 8-336963 | A | 12/1996 |
| JP | 10-58686 | A | 3/1998 |
| JP | 2005-353908 | A | 12/2005 |
| JP | 2010-206007 | * | 9/2010 |

* cited by examiner

*Primary Examiner* — Geoffrey Mruk
(74) *Attorney, Agent, or Firm* — Fitzpatrick, Cella, Harper & Scinto

(57) ABSTRACT

A recording head includes a recording element substrate having a plurality of discharge ports discharging a liquid and energy generating elements generating energy used to discharge the liquid from the discharge ports; an electrical wiring substrate having an opening portion in which the recording element substrate is provided and for applying a driving signal to the recording element substrate; an electrical connection portion in which an electrode portion of the recording element substrate and an electrode portion of the electrical wiring substrate are electrically connected to each other by a wire; and a sealing material covering and sealing the electrical connection portion. The electrical connection portion is provided with a reference member as a reference of at least one of an upper limit position and a lower limit position of the height of the surface of the sealing material with respect to the thickness direction of the recording element substrate.

6 Claims, 12 Drawing Sheets

RECORDING HEAD

BACKGROUND OF THE INVENTION

1. Field of the Invention

The present invention relates to a recording head that is applied to a recording apparatus configured to perform a recording operation by discharging a recording liquid such as ink.

2. Description of the Related Art

FIG. 19 is a perspective view illustrating an ink discharge surface of a recording head 1000 mounted on a general ink jet recording apparatus. Then, FIG. 20 is a perspective view illustrating the opposite side of the ink discharge surface shown in FIG. 19.

A recording element substrate 1100 provided in the recording head 1000 heats ink by an electric thermal conversion element having a heating resistor, and discharges ink droplets from a discharge port 1101 by an action of film boiling.

An electrical wiring substrate 1200 is electrically connected to the recording element substrate 1100 assembled to an open portion, and is configured to apply a driving signal input from an apparatus body (not shown) via a contact portion 1201 to the recording element substrate 1100. The electrical connection portion between the recording element substrate 1100 and the electrical wiring substrate 1200 is protected by a sealing material 1300.

A support member 1400 is used to hold and fix the recording element substrate 1100 and the electrical wiring substrate 1200 thereto. Further, the support member 1400 includes an ink injection port 1401 that is used to supply ink to the recording element substrate 1100. The support member 1400 has a structure in which a filter 1500 and a sealing rubber 1600 are provided in the ink injection port 1401, and a passage is provided to guide ink stored in an ink tank to the recording element substrate 1100.

FIG. 21 is an enlarged view illustrating a portion A of FIG. 19, where the sealing material 1300 is visibly depicted for convenience of description. FIG. 22 is a plan view illustrating a part shown in FIG. 21. FIG. 23 is a cross-sectional view taken along the line 23-23 of FIG. 22.

The recording element substrate 1100 includes a heater board 1104 which has an electric circuit with a heating resistor and an orifice plate 1103 which has a discharge port 1101. Plural electrodes 1102 are provided in the heater board 1104.

In general, the electrical wiring substrate 1200 is formed of a single or double layered FPC board (flexible printed circuit board) or a TAB film. For example, the FPC board has a structure in which interconnections 1202 are provided on a surface of a base film 1203, and a cover film 1204 is provided on the surface. An interconnection portion exposed from an open portion of the cover film is generally subjected to gold-plating to serve as an electrical connection terminal.

As shown in FIG. 24, electrodes 1102 of the recording element substrate 1100 and interconnections 1202 of the electrical wiring substrate 1200 are electrically connected to each other by gold wires 1700 of wire bonding. The electrical connection portion is protected by the sealing material 1300. The sealing material 1300 is provided to cover from the orifice plate 1103 to the cover film 1204.

At the time when the sealing material 1300 is coated on an electrical connection portion, dummy wires not used for electrical connection other than main wires used to drive the recording head may be used to prevent the sealing material 1300 from being dropped, assist a coating process, and reinforce a sealing portion.

Japanese Patent Application Laid-Open No. H07-335680 discloses a semiconductor device that includes a dummy wire having a top point higher than a top point of a wire used in practice for electrical connection. This semiconductor device is sealed by receiving a plate-shaped tablet resin dropped downward using the dummy wire.

Japanese Patent Application Laid-Open No. H08-336963 discloses an ink jet recording head in which a dummy wire is provided at the outside of a wire group. In this ink jet recording head, the sealing material 1300 coated on an electrical connection portion spreads in the dummy wire, thereby protecting the outside of the main wires.

The two-dotted chain line of FIG. 23 is an imaginary line 1301 that represents the shape of the surface of the sealing material 1300. Since the ink jet recording head has a characteristic in which recording quality becomes more improved as a gap between the recording head and a recording medium such as a recording sheet becomes narrower, it is important that the height h5 of the sealing material 1300 protruding more than the orifice plate 1103 is set as low as possible. For this reason, the height h5 of the sealing material 1300 needs to be managed to be a predetermined value or less.

However, in the sealing method of the semiconductor device disclosed in Japanese Patent Application Laid-Open No. H07-335680, since the dummy wire absorbs an impact generated by the dropping of the tablet resin, there are concerns that the dummy wire is deformed and the height of the sealing material is not stably maintained.

Further, the ink jet recording head disclosed in Japanese Patent Application Laid-Open No. H08-336963 controls the height of the sealing material by the coating amount of the sealing material and the spreading degree of the sealing material. However, since the sealing material has a difference in physical property value of viscosity or the like according to a manufacturing lot or a variation in time, the height of the sealing material needs to be frequently examined and the coating condition needs to be adjusted in order to maintain the uniform height of the sealing material.

Therefore, the invention is made in view of such technical problems of the related art, and achieves the following purposes.

That is, an object of the invention is to improve a recording quality of a recording head by rapidly performing a feedback to a sealing process and reducing a difference in the height of a sealing material due to a configuration capable of simply determining whether a height of a sealing material of the recording head is more than a predetermined upper limit position.

Further, there is another problem in that a coating portion of an electrical connection portion, that is, the coating thickness t7 of the gold wire 1700 formed in a protruding manner is thinned when the height of the sealing material is too low, so that electrical reliability may be degraded.

Accordingly, a second object of the invention is to provide a configuration capable of simply determining whether the height of the sealing material of the recording head is lower than the predetermined lower limit position. Therefore, electrical reliability of the recording head may be improved by rapidly performing a feedback to the sealing process, and reducing a difference in the height of the sealing material.

SUMMARY OF THE INVENTION

A recording head includes: a recording element substrate which has a plurality of discharge ports discharging a liquid and an energy generating element generating energy used to discharge the liquid from the discharge ports; an electrical wiring substrate having an opening portion in which the recording element substrate is provided and applies a driving signal to the recording element substrate; an electrical connection portion in which an electrode portion of the recording element substrate and an electrode portion of the electrical wiring substrate are electrically connected to each other by a wire; and a sealing material which covers and seals the electrical connection portion, wherein the electrical connection portion is provided with a reference member used as a reference of at least one of an upper limit position and a lower limit position of the height of the surface of the sealing material with respect to the thickness direction of the recording element substrate.

Further features of the present invention will become apparent from the following description of exemplary embodiments with reference to the attached drawings.

DESCRIPTION OF THE EMBODIMENTS

Hereinafter, a configuration and an effect of an ink jet recording head of the preferred embodiments will be described by referring to the accompanying drawings.

First Embodiment

Figure 1:
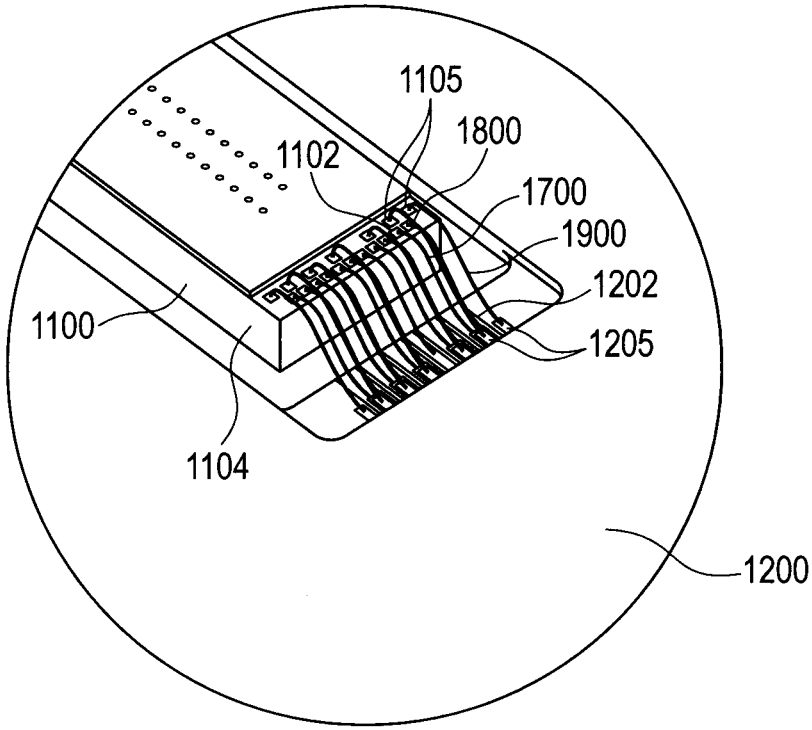
FIG. 1 is a perspective view illustrating a main part of an ink jet recording head of a first embodiment.
Figure 2:
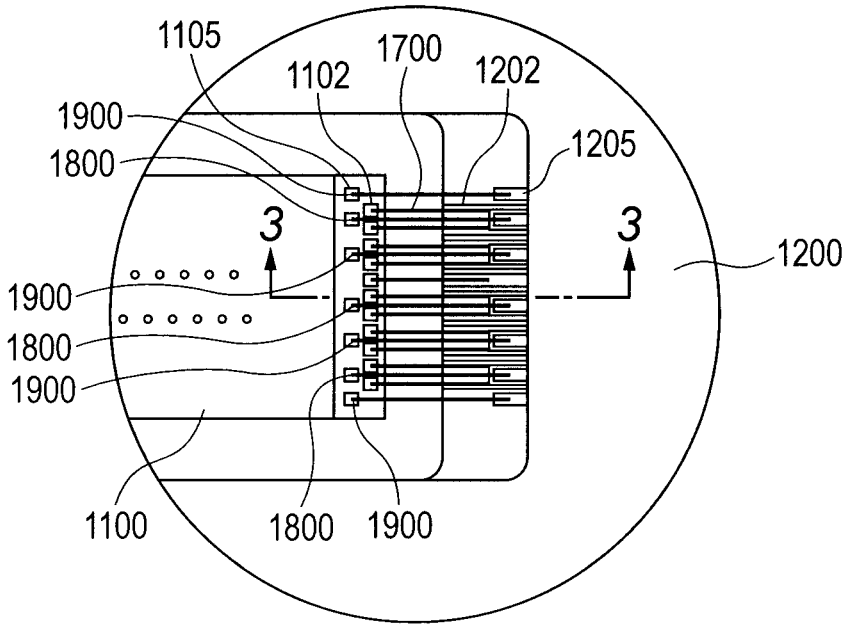
FIG. 2 is a plan view illustrating a main part of the ink jet recording head of the first embodiment.
Figure 3:
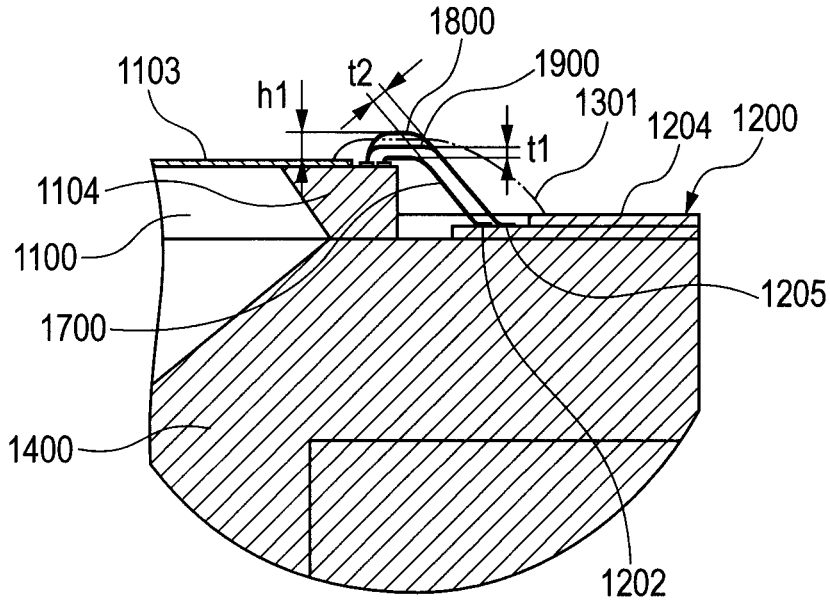
FIG. 3 is a cross-sectional view taken along the line 3-3 of FIG. 2.

FIG. 1 is a perspective view illustrating a main part of an ink jet recording head of a first embodiment, where a sealing material is visibly depicted for convenience of description. FIG. 2 is a plan view illustrating a part shown in FIG. 1. FIG. 3 is a cross-sectional view taken along the line 3-3 of FIG. 2.

A recording element substrate 1100 includes a heater board 1104 which is a substrate having an electric circuit formed on a surface of an Si chip and an orifice plate 1103 which is formed of a resin material and has a discharge port or the like formed by photolithography. The heater board 1104 includes a heater which is an energy generating element generating discharge energy used to discharge a liquid as ink from the discharge port.

The heater board 1104 includes plural electrode portions at its end portion, and the electrode portions include plural gold-plated electrodes 1102 and plural gold-plated electrodes 1105. The electrodes 1102 are connected to main wires that are electrically connected to a printer body in order to drive the recording element substrate 1100. On the other hand, the electrodes 1105 are connected to a dummy wire that does not take any action involved with the operation of driving the recording element substrate 1100. The electrodes 1105 are provided on the inside of the electrodes 1102 on the main surface of the heater board 1104. The recording element substrate 1100 is adhered and fixed onto a support member 1400 by substrate adhesive. The substrate adhesive is a UV thermosetting type that is hardened by UV ray irradiating or heating, and has a resistance against ink.

An FPC board (flexible printed circuit board) is used as the electrical wiring substrate 1200. The FPC board is a film formed of polyimide and has a base film with a thickness equal to or more than 0.025 mm and equal to or less than 0.050 mm, and includes interconnections 1202 and 1205, each of which is formed of copper and has a width equal to or more than 0.1 mm and equal to or less than 0.2 mm and a thickness equal to or more than 0.01 mm and equal to or less than 0.02 mm. Then, a cover film 1204 is provided on the surface of the electrical wiring substrate 1200. In addition, the electrical wiring substrate 1200 has an open portion that is used to assemble the recording element substrate 1100 thereto. A part of the interconnections 1202 and 1205 are exposed to the edge portion of the open portion to form electrode portions, and gold plating is performed on the electrode portions. The cover film 1204 is a film that is formed of aramid having a thickness equal to or more than 0.004 mm and equal to or less than 0.050 mm or polyimide having a thickness equal to or more than 0.01 mm and equal to or less than 0.05 mm, and is provided to cover the interconnections using adhesive. The adhesive has a thickness equal to or more than 0.02 mm and equal to or less than 0.05 mm. The interconnections 1202 are connected to the main wires that are electrically connected to the printer body in order to apply a driving signal to the recording element substrate 1100. On the other hand, the interconnections 1205 are connected to the dummy wire that does not take any action involved with the operation of driving the recording element substrate 1100. The wire bonding position of each interconnection 1205 provided at the edge portion of the open portion that is formed in the electrical wiring substrate 1200 to assemble the recording element substrate 1100 thereto is disposed farther on the outside of the open portion than the wire bonding position of each interconnection 1202 as shown in FIG. 3.

The electrical wiring substrate 1200 is also adhered and fixed onto the support member 1400 by adhesive. Like the above-described substrate adhesive, this adhesive is also a UV thermosetting type that is hardened by UV ray irradiating or heating, and has a resistance against ink.

The electrodes 1102 of the electrode portions of the recording element substrate 1100 and the end portion of the interconnections 1202 of the electrode portions of the electrical wiring substrate 1200 are electrically connected to each other by the gold wires (main wires) 1700 of the wire bonding.

Then, the electrodes 1105 and the interconnections 1205 are connected to each other by the dummy wire. As the dummy wire which is a reference member, there are provided two types of dummy wires such that first dummy wires 1800 are provided to be used as a reference of the upper limit position of the height (coating height) of the sealing material, and second dummy wires 1900 are provided to be used as a reference of the lower limit position of the height of the sealing material.

As shown in FIG. 3, the first dummy wires 1800 used as the reference of the upper limit position of the height of the sealing material are formed such that the top points thereof are located at the height h1 which is the upper limit of the height of the sealing material from the orifice plate 1103. Further, the second dummy wires 1900 used as the reference of the lower limit position of the height of the sealing material are formed to be maintained at the lower limit value t1 of the coating thickness of each main wire 1700. The coating thickness of the sealing material needs to be uniformly maintained throughout the entire area of the main wires 1700 in the longitudinal direction. For this reason, it is desirable that the coating thickness is uniformly maintained throughout the entire area of the main wires 1700, such that the coating thickness is maintained to be the lower limit value t2 not only at the top point of each main wire, but also at the obliquely extending portion of each main wire 1700. Accordingly, a relationship of t1=t2 is established.

Figure 4:
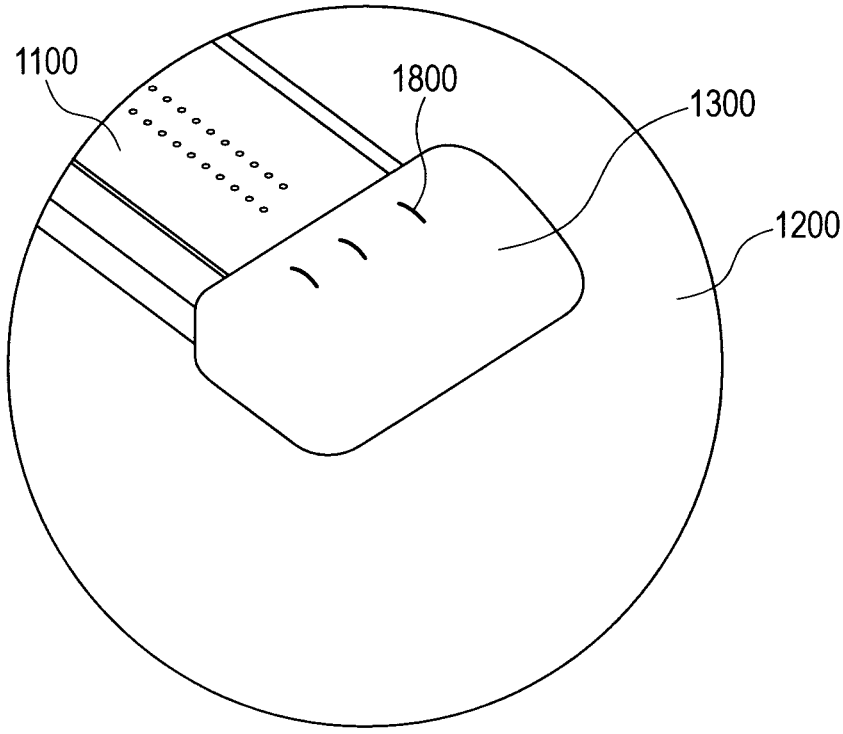
FIG. 4 is a perspective view illustrating a state where a sealing material is coated on an electrical connection portion.

The two-dotted chain line of FIG. 3 is an imaginary line 1301 that represents the shape of the surface of the sealing material. The appropriate coating amount may be easily determined by the naked eye on the basis of whether the height of the sealing material is located at a position between the two types of dummy wires 1800 and 1900, and is not lower than the positions of the second dummy wires 1900 used as the reference of the lower limit position in the entire surface of the sealing material. FIG. 4 is a perspective view illustrating a state where the sealing material is coated on an electrical connection portion. The sealing material 1300 covers the electrical connection portion between the recording element substrate 1100 and the electrical wiring substrate 1200, and is coated from the orifice plate 1103 to the cover film. Then, when the coating amount of the sealing material 1300 is appropriate, only the first dummy wires 1800 used as the reference of the upper limit position are exposed from the sealing material 1300. In the embodiment, for example, the first dummy wire 1800 is formed to have a top portion with 300 μm of height relative to the wire with 80 μm of height from the recording element substrate 1100. Further, the shape of the second dummy wire 1900 used as the reference of the lower limit position is formed so that the coating thickness of the wire is 100 μm. That is, the second dummy wire 1900 is formed in a shape in which its top portion has 180 μm of height from the recording element substrate 1100. Accordingly, the sealing material 1300 may be coated on the electrical connection portion so that the top point of the sealing material 1300 has a center value so as to have 240 μm of height from the recording element substrate 1100.

Figure 5:
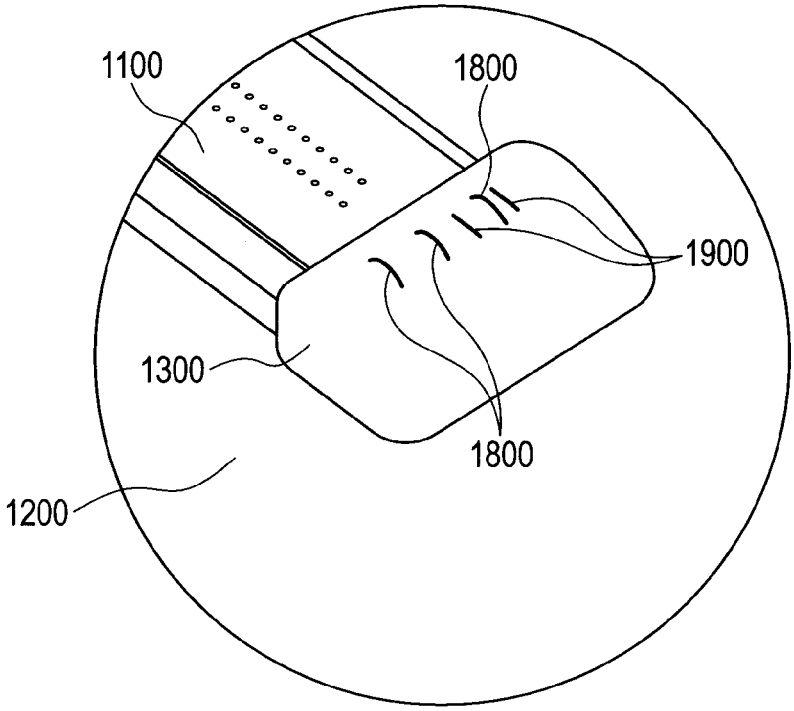
FIG. 5 is a perspective view illustrating a state where the coating amount of the sealing material is not sufficient.

Further, FIG. 5 is a perspective view illustrating a state where the coating amount of the sealing material 1300 is not sufficient. When the coating amount of the sealing material 1300 is at the lower limit, at least one of the second dummy wires 1900 serving as the reference of the lower limit position is exposed. When the coating amount of the sealing material 1300 is not sufficient, the surface of the sealing material 1300 is lower than the external shapes of the second dummy wires 1900, whereby the insufficient coating amount may be easily determined.

Regarding the arrangement of the wires in the plan view, as shown in FIG. 2, the second dummy wires 1900 serving as a reference of the lower limit position of the sealing material are disposed on both outside portions in the arrangement direction of the main wires 1700. As described above, the electrical connection portion includes plural first dummy wires 1800 and plural second dummy wires 1900 that are provided above a group of the main wires 1700, where the plural first dummy wires 1800 are used as the reference of the upper limit position of the sealing material and the plural second dummy wires 1900 are used as the reference of the lower limit position of the sealing material. In order that the first and second dummy wires 1800 and 1900 serve as the references for determining the coating amount of the sealing material 1300, the dummy wires 1800 and 1900 need to be arranged with a sufficient interval therebetween so that the meniscus is not stretched therebetween. Accordingly, as in the embodiment, it is desirable that the first dummy wires 1800 are not arranged to be adjacent to each other. For the same reason, it is desirable that the second dummy wires 1900 are not arranged to be adjacent to each other.

The ink jet recording head having the above-described configuration may simply determine whether the height of the sealing material 1300 is more than the predetermined upper limit position by visual determination or by an image process. For this reason, since the examination time for the coating state may be shortened, a feedback to the sealing process may be rapidly conducted. Therefore, a difference in the height of the sealing material 1300 may be reduced, and the recording quality of the recording head may be improved.

Further, the ink jet recording head may simply determine whether the height of the sealing material 1300 is lower than the predetermined lower limit position by visual determination or by an image process. For this reason, since the examination time for the coating state may be shortened, a feedback to the sealing process may be rapidly conducted. Therefore, a difference in the height of the sealing material 1300 may be reduced, and the electrical reliability of the recording head may be improved.

Figure 6:
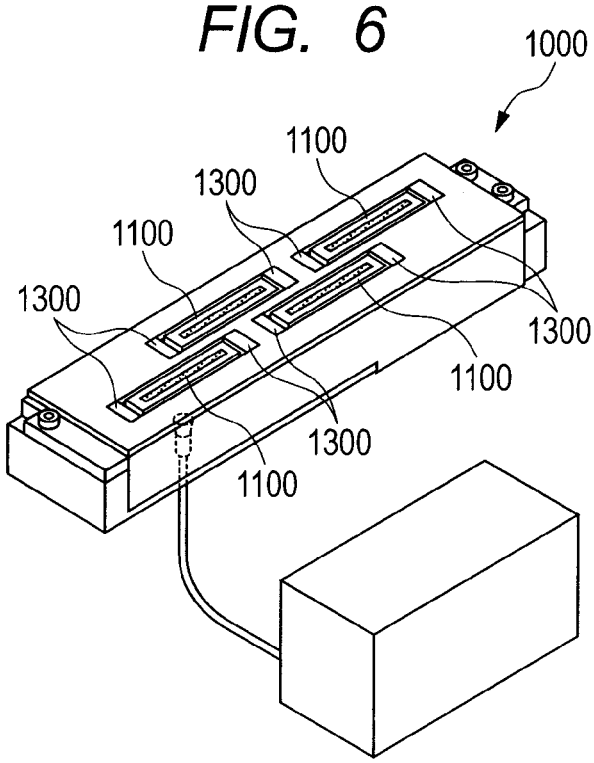
FIG. 6 is a perspective view illustrating an example of an ink jet recording head provided with plural recording element substrates.

Further, FIG. 6 is a perspective view illustrating an example of a recording head 1000 provided with four recording element substrates 1100. Particularly, the invention may be effectively used in the recording head in which the sealing material 1300 is coated at plural positions. Since the ink jet recording head may simply determine whether the height of the sealing material 1300 is more than the upper limit position or the height of the sealing material 1300 is lower than the lower limit position, a difference in the height of the plural sealing materials 1300 may be reduced, so that the above-described effect may be obtained.

Second Embodiment

Figure 7:
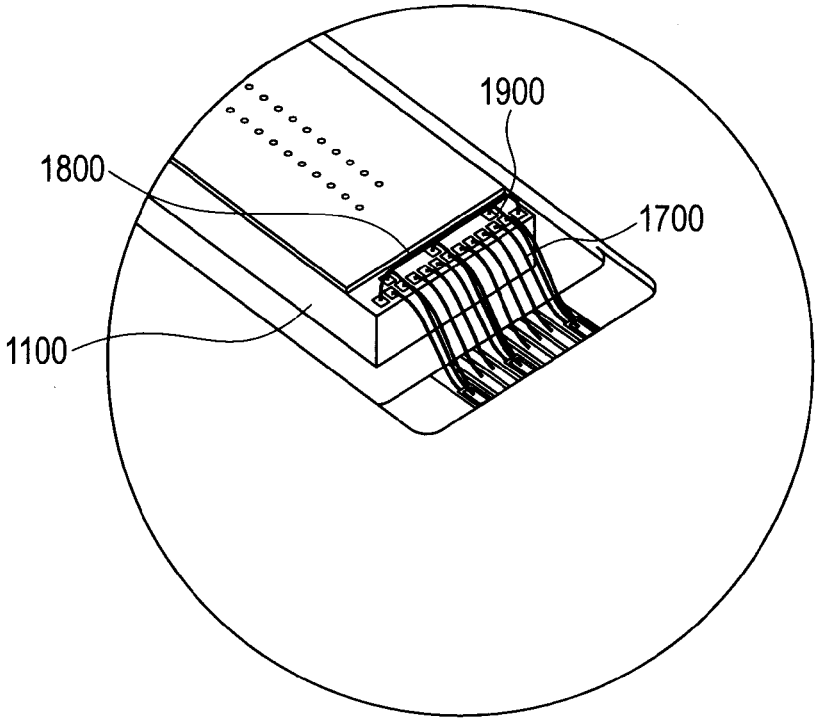
FIG. 7 is a perspective view illustrating a main part of an ink jet recording head of a second embodiment.
Figure 8:
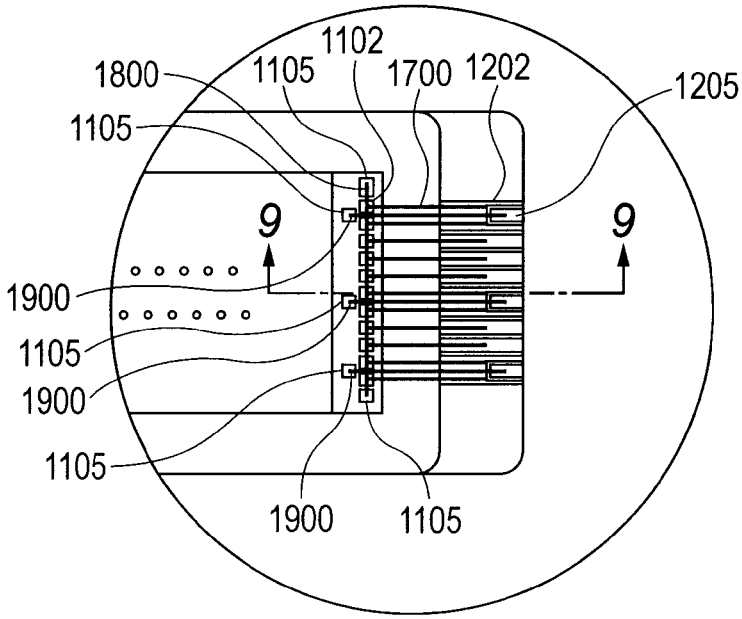
FIG. 8 is a plan view illustrating a main part of the ink jet recording head of the second embodiment.
Figure 9:
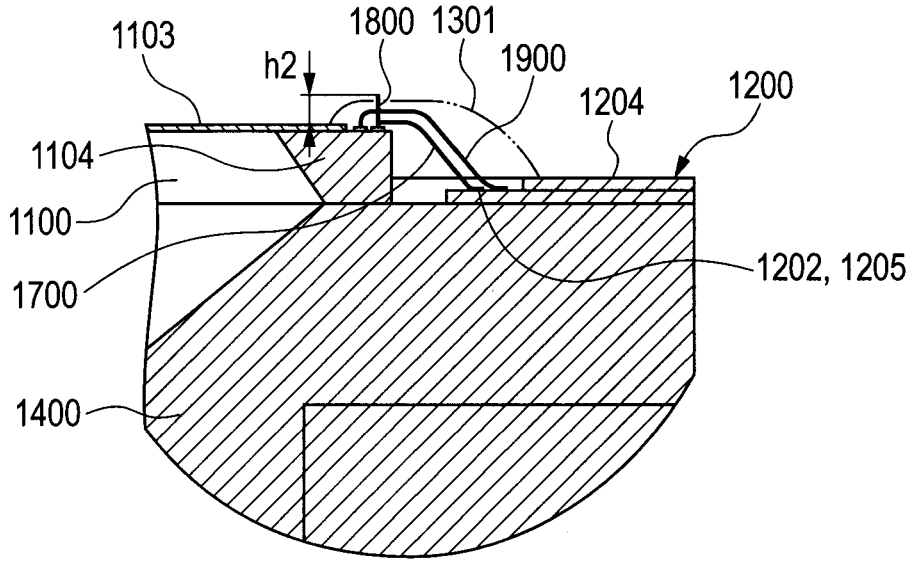
FIG. 9 is a cross-sectional view taken along the line 9-9 of FIG. 8.
Figure 10:
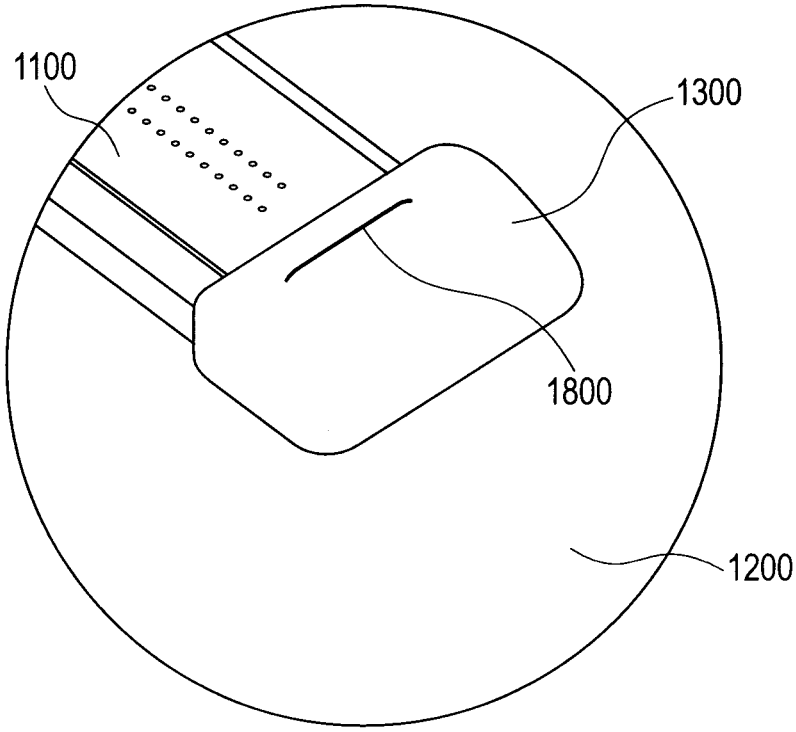
FIG. 10 is a perspective view illustrating a state where a sealing material is coated on an electrical connection portion.

FIG. 7 is a perspective view illustrating a main part of an ink jet recording head of a second embodiment, where the sealing material 1300 is visibly depicted for convenience of description. FIG. 8 is a plan view illustrating a main part shown in FIG. 7. FIG. 9 is a cross-sectional view taken along the line 9-9 of FIG. 8. FIG. 10 is a perspective view illustrating a state where the sealing material 1300 is coated on the electrical connection portion.

In the second embodiment, the first dummy wires 1800 used as the reference of the upper limit position are formed in a manner different from the first embodiment. The second dummy wires 1900 used as the reference of the lower limit position are provided along the shape of the main wires 1700 in the same manner as the first embodiment. On the other hand, the first dummy wires 1800 used as the reference of the upper limit position are provided along the arrangement direction of the electrodes 1105 only on the recording element substrate 1100 as shown in FIG. 7. As shown in FIG. 9, in the configuration of the recording head, the height of the sealing material 1300 becomes easily higher at the side of the recording element substrate 1100 compared with the side of the electrical wiring substrate 1200 due to its wire-like shape. For this reason, the first dummy wires 1800 used as the reference of the upper limit position may be provided only on the recording element substrate 1100. Unlike the case of FIG. 9, when the height of the sealing material becomes higher at the side of the electrical wiring substrate 1200, it is desirable that the first dummy wires 1800 used as the reference of the upper limit position are provided at the side of the electrical wiring substrate 1200.

Regarding the arrangement of the first dummy wires 1800, as shown in FIG. 8, the first dummy wires may be provided in the arrangement of the group of the electrodes 1102 where the main wires 1700 tend to easily become higher. Then, as shown in FIG. 10, at the time when the sealing material 1300 is coated on the electrical connection portion, the positional relationship between the surface of the sealing material 1300, the first dummy wires 1800, and the second dummy wires 1900 are checked by the naked eye in the same manner as the first embodiment. At this time, it is determined that the coating amount of the sealing material 1300 is appropriate when the first dummy wires 1800 used as the reference of the upper limit position of the sealing material 1300 are exposed from the sealing material and the height of the sealing material is not lower than the second dummy wires 1900 used as the reference of the lower limit position of the sealing material 1300.

In the ink jet recording head according to the second embodiment with the above-described configuration, since the electrical wiring substrate 1200 does not need to have the dummy interconnections forming the first dummy wires 1800 used as the reference of the upper limit position, the configuration may be simplified.

Third Embodiment

Figure 11:
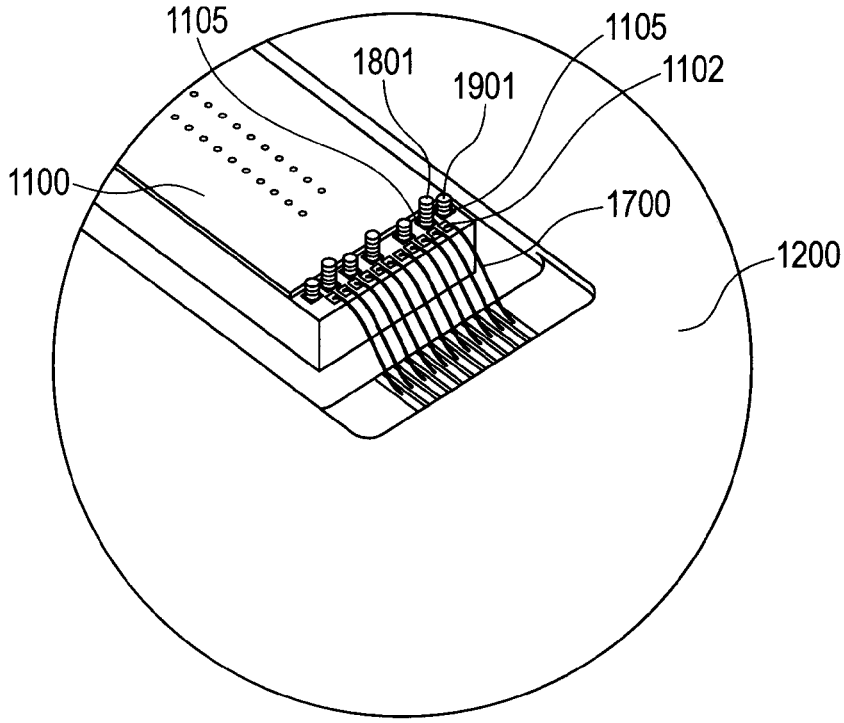
FIG. 11 is a perspective view illustrating a main part of an ink jet recording head of a third embodiment.
Figure 12:
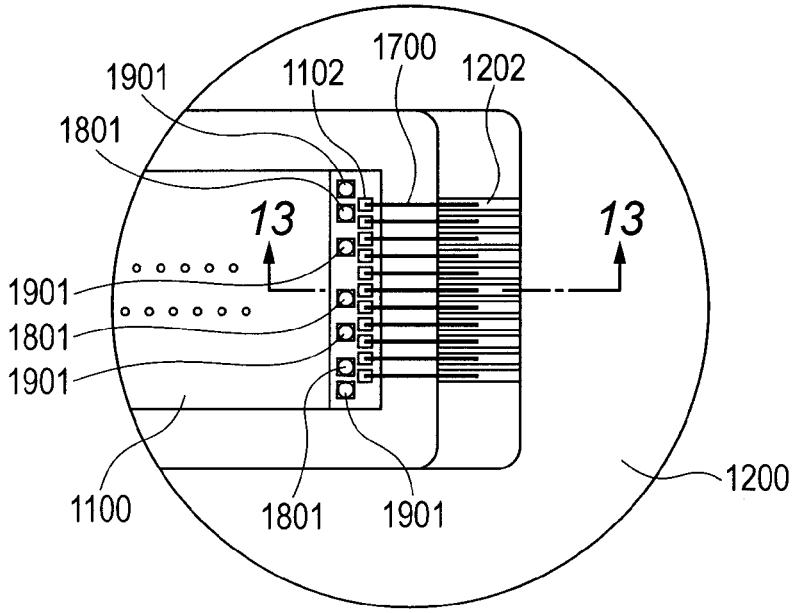
FIG. 12 is a plan view illustrating a main part of the ink jet recording head of the third embodiment.
Figure 13:
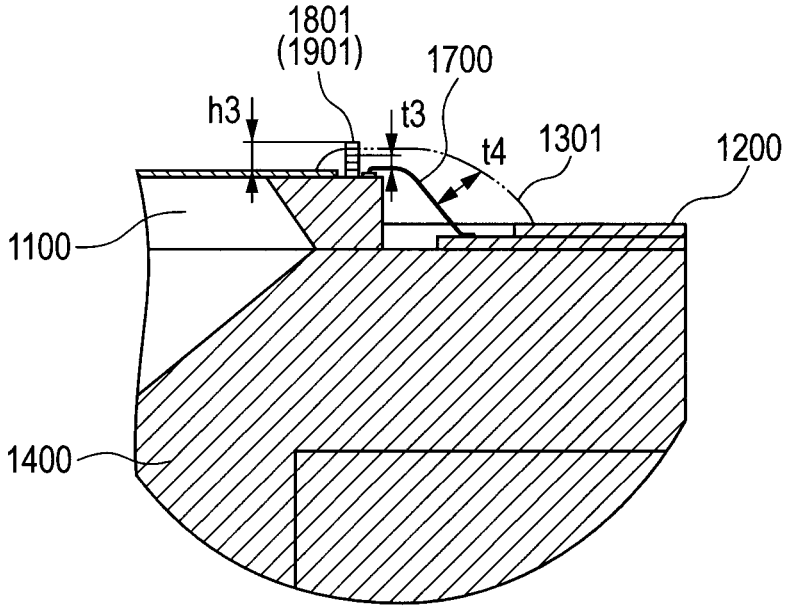
FIG. 13 is a cross-sectional view taken along the line 13-13 of FIG. 12.
Figure 14:
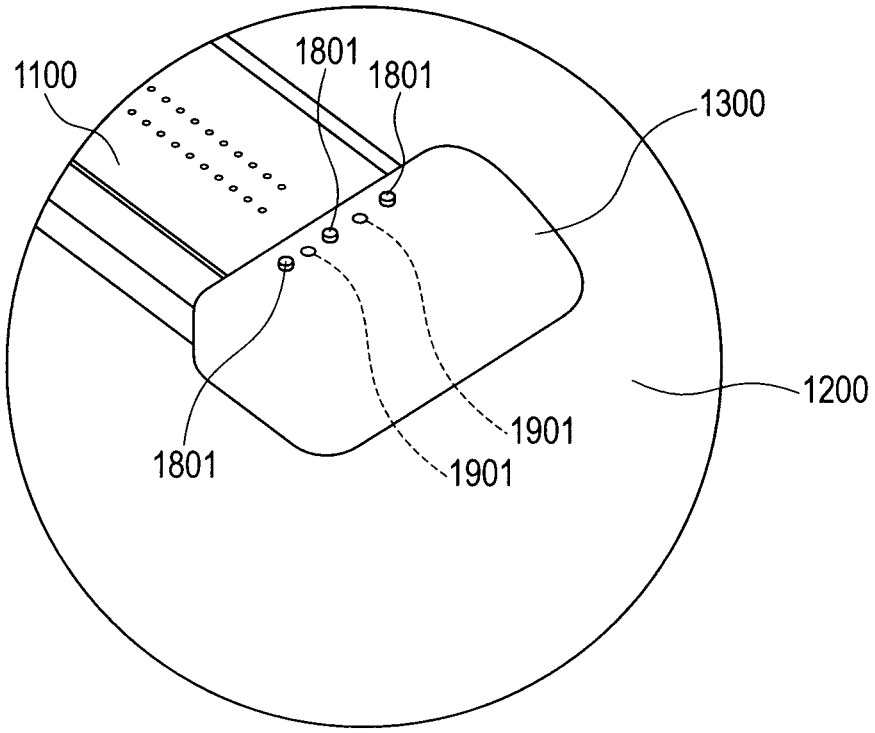
FIG. 14 is a perspective view illustrating a state where a sealing material is coated on an electrical connection portion.

FIG. 11 is a perspective view illustrating a main part of an ink jet recording head of a third embodiment, where the sealing material 1300 is visibly depicted for convenience of description. FIG. 12 is a plan view illustrating a main part shown in FIG. 11. FIG. 13 is a cross-sectional view taken along the line 13-13 of FIG. 12. FIG. 14 is a perspective view illustrating a state where the sealing material 1300 is coated on the electrical connection portion.

As shown in FIG. 11, in the third embodiment, the recording element substrate 1100 and the electrical wiring substrate 1200 are electrically connected to each other by the main wire 1700. Plural first columns 1801 and plural second columns 1901 are arranged at the position adjacent to the group of the electrodes 1102 on the recording element substrate 1100, where the first columns serve as columnar members used as the reference of the upper limit position of the sealing material, and the second columns serve as columnar members used as the reference of the lower limit position of the sealing material.

As shown in FIG. 13, the first columns 1801 have the upper limit height h3 of the sealing material 1300, and the second columns 1901 have the height equal to the lower limit of the coating thickness t3 of the sealing material 1300. The two-dotted chain line of FIG. 13 indicates the imaginary line 1301 of the shape of the surface of the sealing material 1300. When the coating thickness t4 of the inclined portion of the surface of the sealing material 1300 is apparently thicker than the coating thickness t3 of the sealing material 1300 in the vicinity of the top point of the main wires 1700, the second columns 1901 used as the reference of the lower limit position of the sealing material are disposed only in the vicinity of the top point of the main wire 1700. When the second columns 1901 are disposed in this manner, the configuration may be simplified. When the amount of the coating thickness t4 is not clearly estimated, it may be effective to adopt the combination of the dummy wires 1900 used as the reference of the lower limit position of the sealing material and formed along the shape of the main wire 1700 and the columns 1801 used as the upper limit position in the same manner as the first embodiment.

Regarding the arrangement of the columns 1801 and 1901 in the plan view, as shown in FIG. 12, the second columns 1901 used as the reference of the lower limit position of the sealing material are disposed on both outside portions in the arrangement direction of the main wires 1700 in the same manner as the first embodiment. Likewise, at the electrical connection portion, it is effective to dispose the first columns 1801 used as the reference of the upper limit position and the second columns 1901 used as the reference of the lower limit position to be adjacent to the group of the electrodes 1102 of the main wires 1700 in the transverse direction.

Regarding the formation of the column, the column may be formed of a resin material by photolithography, but may be formed by laminating ball bumps. The method of laminating the ball bumps is generally used. For example, Japanese Patent Application Laid-Open No. H10-58686 discloses an example in which laminated or layered ball bumps are used to conduct inner lead bonding. Further, Japanese Patent Application Laid-Open No. 2005-353908 discloses an example in which laminated ball bumps are used to conduct flip tip mounting of electronic devices laminated in plural layers.

In the embodiment, for example, when the height of the main wire 1700 is 80 μm on the recording element substrate 1100, each first column 1801 used as the reference of the upper limit position is formed by laminating ball bumps each having 60 μm of height in five layers so that the total height becomes 300 μm. Further, in this case, each second column 1901 used as the reference of the lower limit position may be formed by laminating ball bumps each having 60 μm of height in three layers so that the total height becomes 180 μm. The uppermost surface of the laminated ball bumps is leveled by a capillary having a flat front end.

Then, as shown in FIG. 14, at the time when the sealing material 1300 is coated on the electrical connection portion, the positional relationship between the surface of the sealing material 1300, the first columns 1801 used as the reference of the upper limit position, and the second columns 1901 used as the reference of the lower limit position is checked by the naked eye in the same manner as the first embodiment. At this time, it is determined that the coating amount of the sealing material 1300 is appropriate when the first columns 1801 are exposed from the sealing material 1300 and the sealing material 1300 is not lower than the top points of the second columns 1901.

According to the ink jet recording head of the third embodiment with the above-described configuration, since the electrical wiring substrate does not need to have the dummy interconnections forming the dummy wires used as the reference of the upper limit position, the configuration may be simplified.

Fourth Embodiment

Figure 15:
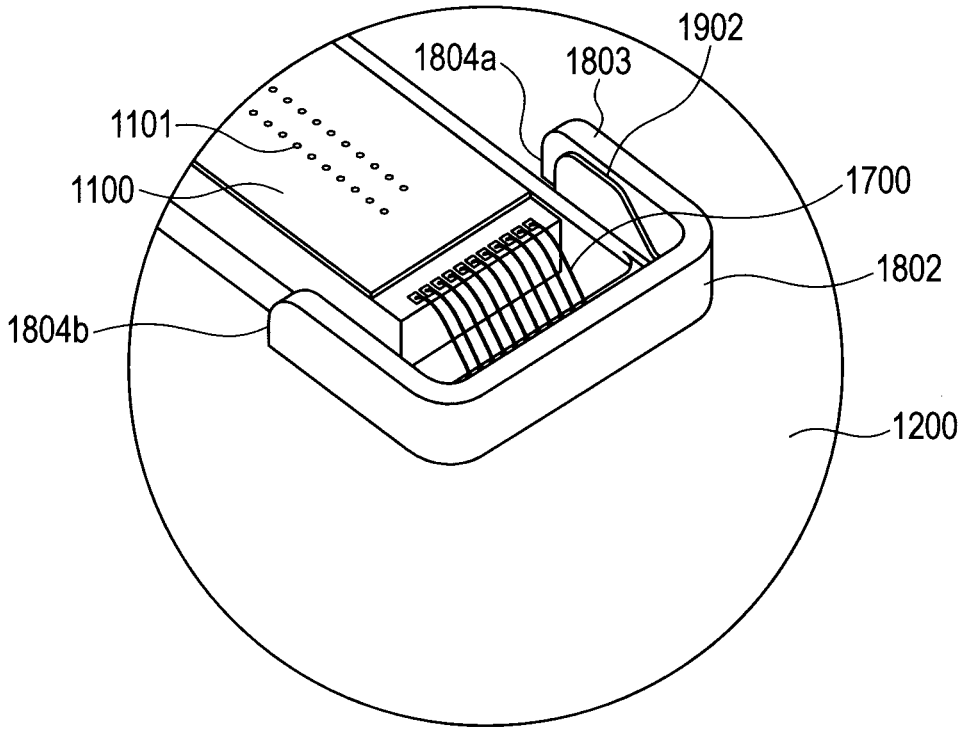
FIG. 15 is a perspective view illustrating a main part of an ink jet recording head of a fourth embodiment.
Figure 16:
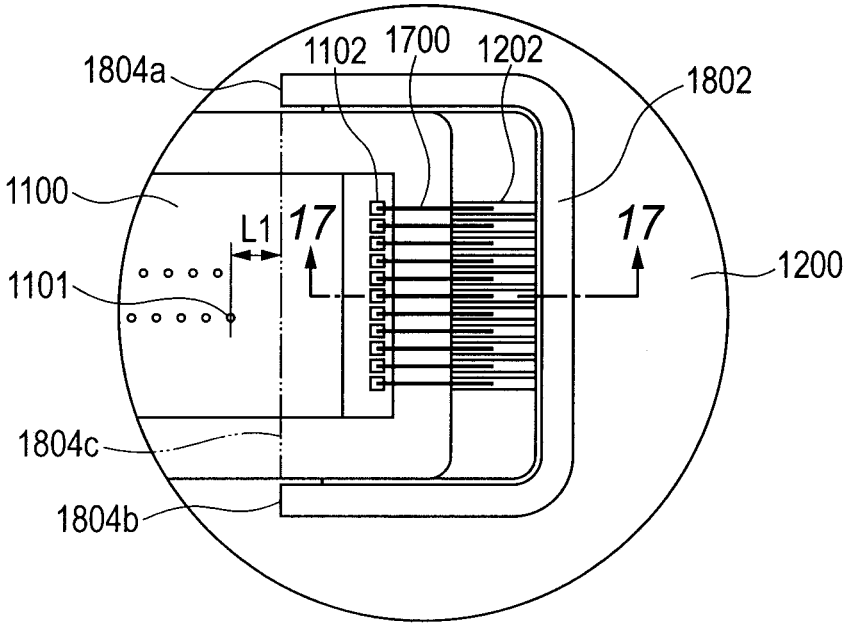
FIG. 16 is a plan view illustrating a main part of the ink jet recording head of the fourth embodiment.
Figure 17:
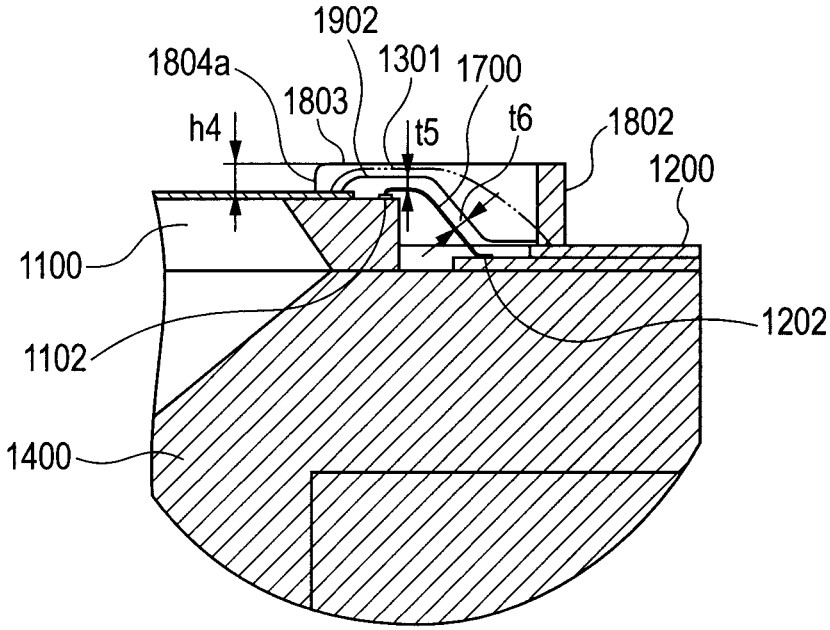
FIG. 17 is a cross-sectional view taken along the line 17-17 of FIG. 16.
Figure 18:
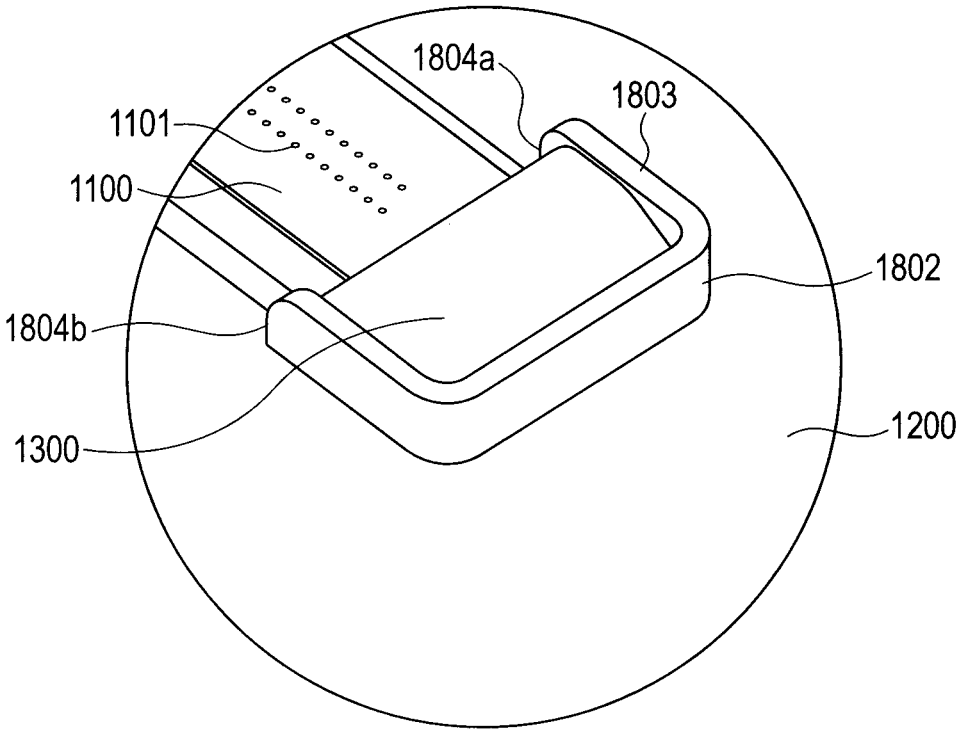
FIG. 18 is a perspective view illustrating a state where a sealing material is coated on an electrical connection portion.
Figure 19:
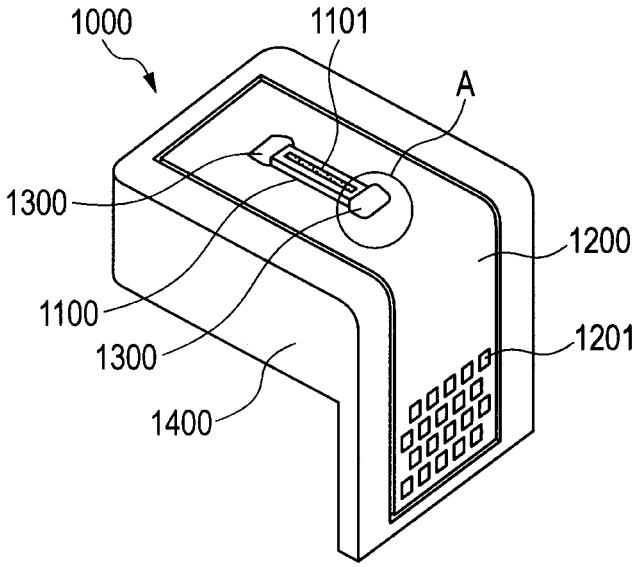
FIG. 19 PRIOR ART
FIG. 19 is a perspective view illustrating the ink jet recording head according to the invention.
Figure 20:
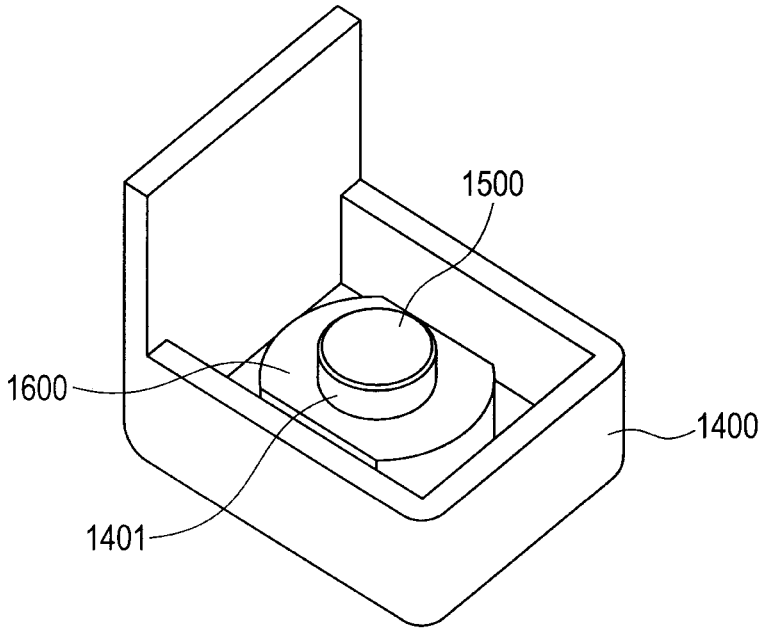
FIG. 20 PRIOR ART
FIG. 20 is a perspective view illustrating the ink jet recording head according to the invention when seen from an opposite side of an ink discharge surface.
Figure 21:
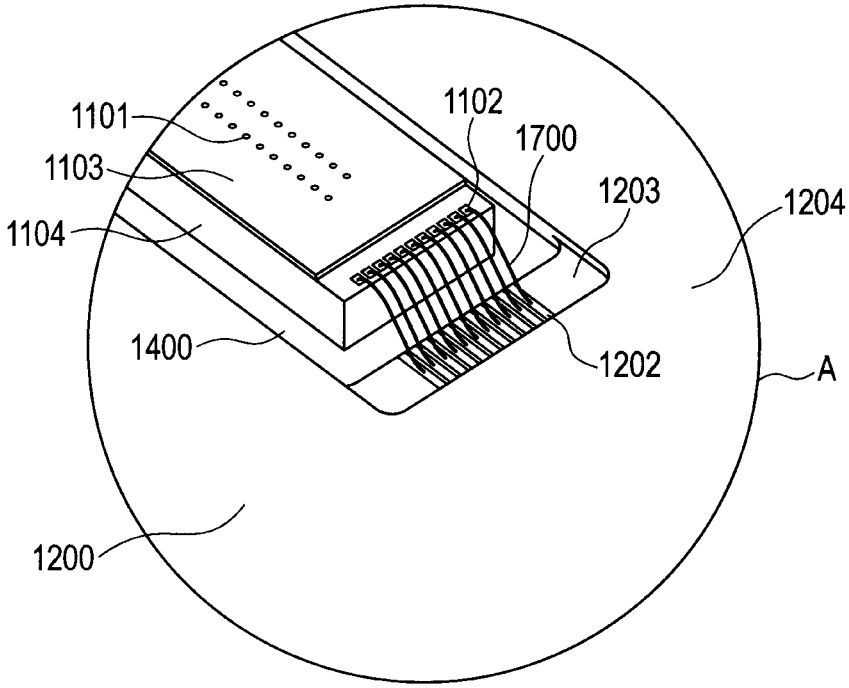
FIG. 21 PRIOR ART
FIG. 21 is an enlarged view illustrating a portion A of FIG. 19.
Figure 22:
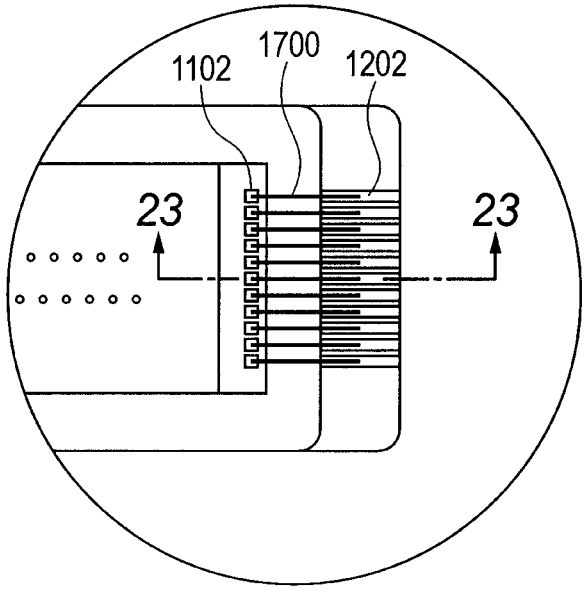
FIG. 22 PRIOR ART
FIG. 22 is a plan view illustrating a portion A of FIG. 21.
Figure 23:
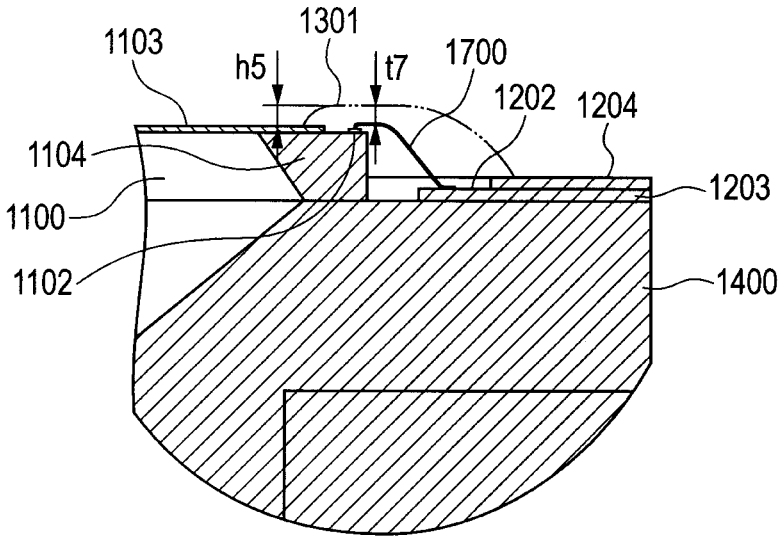
FIG. 23 PRIOR ART
FIG. 23 is a cross-sectional view taken along the line 23-23 of FIG. 22.
Figure 24:
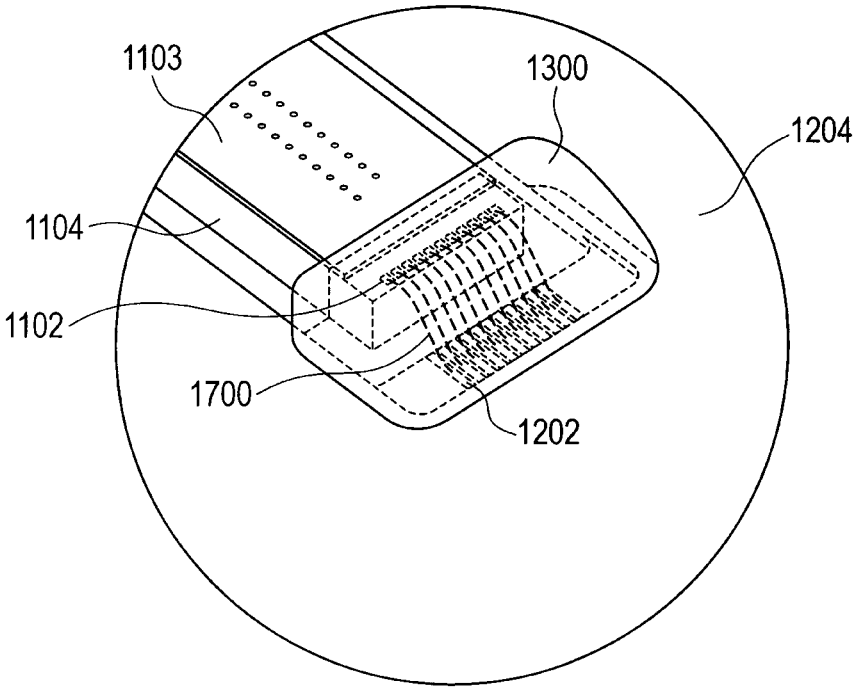
FIG. 24 PRIOR ART
FIG. 24 is a perspective view illustrating a state where a sealing material is coated on an electrical connection portion.

FIG. 15 is a perspective view illustrating a main part of an ink jet recording head of a fourth embodiment, where the sealing material 1300 is visibly depicted for convenience of description. FIG. 16 is a plan view illustrating a main part shown in FIG. 15. FIG. 17 is a cross-sectional view taken along the line 17-17 of FIG. 16. FIG. 18 is a perspective view illustrating a state where the sealing material 1300 is coated on the electrical connection portion.

In the fourth embodiment, as shown in FIG. 15, a wall portion 1802 is provided on the electrical wiring substrate 1200, where the wall portion is formed as a wall-shaped member and is used as the reference of the upper limit position and the lower limit position of the height of the sealing material 1300. The wall portion 1802 is formed in a U-shaped wall surrounding the electrical connection portion on the plane perpendicular to the thickness direction of the recording element substrate 1100. Then, the wall portion 1802 includes an upper surface 1803 which is a reference surface used as a reference of the upper limit position of the sealing material, and the upper surface 1803 is formed at a position of the height h4 distant from the upper surface of the recording element substrate 1100. Further, the inner surface of the wall portion 1802 is provided with a reference line 1902 which is a reference of the lower limit position. The reference line 1902 is formed along the extension direction of the main wire 1700, and the gap between the reference line 1902 and the main wire 1700 is formed to have the minimum coating thicknesses t5 and t6 (t5=t6).

Then, as shown in FIG. 18, at the time when the sealing material 1300 is coated on the electrical connection portion, the positional relationship between the surface of the sealing material 1300, the upper surface 1803 used as the reference of the upper limit position of the height of the sealing material 1300, and the reference line 1902 used as the reference of the lower limit position of the sealing material may be checked by the naked eye. At this time, it is determined that the coating amount of the sealing material 1300 is appropriate when it is checked by the naked eye that the surface of the sealing material 1300 is not higher than the upper surface 1803 and the sealing material 1300 is coated above the reference line 1902.

Further, as shown in FIG. 17, the wall portion 1802 is not only used as the reference in the vertical direction as the thickness direction of the recording element substrate 1100. The wall portion 1802 includes side surfaces 1804*a* and 1804*b* which are reference surfaces used as the reference of the position with respect to the direction perpendicular to the thickness direction of the recording element substrate 1100. In other words, the wall portion 1802 includes the side surfaces 1804*a* and 1804*b* which are used as the reference of the upper limit position of the coating amount in the direction facing the discharge port 1101 (the arrangement direction of the plural discharge ports 1101) in the plane perpendicular to the thickness direction of the recording element substrate 1100. As shown in FIG. 16, the wall portion 1802 includes the side surfaces 1804*a* and 1804*b* which are used as the reference of the upper limit position with the recording element substrate 1100 interposed therebetween. An imaginary line 1804*c* showing the shape of the surface of the sealing material 1300 and connecting the side surfaces 1804*a* and 1804*b* indicates the upper limit position capable of allowing the widening degree of the sealing material 1300 with respect to the direction facing the discharge port 1101. In this manner, by ensuring the distance L1 from the discharge port 1101 located at one end of the arrangement direction of the group of the discharge ports 1101 to the upper limit position of the sealing material 1300, the surface of the orifice plate 1103 of the ink jet recording head may be satisfactorily cleaned.

In the ink jet recording head of the fourth embodiment, the wall portion 1802 used as the reference of the upper limit position and the lower limit position of the sealing material is not only used to easily determine the coating amount of the sealing material 1300 in the vertical direction, but is also used as the reference of the upper limit position of the sealing material 1300 widened toward the discharge port 1101. For this reason, in the embodiment, the coating amount of the sealing material 1300 may be three-dimensionally easily determined. Further, since the wall portion 1802 of the embodiment serves as a wall suppressing the widening state of the sealing material 1300 on the electrical wiring substrate 1200, the coating process of the sealing material 1300 may be easily performed.

Furthermore, the invention may be applied to a copying machine, a facsimile machine having a communication system, an electronic device such as a word processor having a printing unit, and an industrial recording apparatus complexly combined with various processing devices as well as the general printing device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-044138, filed Mar. 1, 2010, which is hereby incorporated by reference herein in its entirety.

What is claimed is:

1. A recording head comprising:

a recording element substrate which has a plurality of discharge ports discharging a liquid and energy generating elements generating energy used to discharge the liquid from the discharge ports;

an electrical wiring substrate which has an open portion used to dispose the recording element substrate therein and applies a driving signal to the recording element substrate;

an electrical connection portion in which an electrode portion of the recording element substrate and an electrode portion of the electrical wiring substrate are electrically connected to each other by a wire; and a sealing material which covers the electrical connection portion, wherein a first reference member and a second reference member are formed in the vicinity of the electrical connection, the first reference member being higher than the wire with respect to a surface of the electrode portion of the recording element substrate, the second reference member being higher than the first reference member with respect to the surface of the electrode portion of the recording element substrate, the wire and the first reference member are covered with the sealing material, and at least a part of the second reference member is exposed through the sealing material.

2. The recording head of claim 1, wherein the first reference member and the second reference member are dummy wires that are not used to drive the energy generating elements.

3. The recording head of claim 1, wherein the first reference member and the second reference member are columnar members which are provided on the recording element substrate in the thickness direction.

4. The recording head of claim 3, wherein the columnar members are formed by laminating a plurality of ball bumps in the thickness direction.

5. The recording head of claim 1, wherein the first reference member and the second reference member are wall portions which are provided in the periphery of the electrical connection portion.

6. The recording head of claim 5, wherein the upper surface of the wall portion that forms the second reference member in the height direction is a reference surface used as a reference of an upper limit of the sealing material.

* * * * *